United States Patent [19]

Bernecki et al.

[11] 4,417,681

[45] Nov. 29, 1983

[54] ELECTRONIC TACKER

[75] Inventors: Harry F. Bernecki, Rolling Meadows; Voytech T. Skuza, Park Ridge; Kerry Dulin, Highland Park; Sri P. Sridharan, Hickory Hills; Glenn Zabec, Franklin Park, all of Ill.; James E. Edgell, Salem, Va.

[73] Assignee: Textron Inc., Providence, R.I.

[21] Appl. No.: 294,422

[22] Filed: Aug. 19, 1981

[51] Int. Cl.[3] ..... B25C 5/15

[52] U.S. Cl. ..... 227/8; 227/131

[58] Field of Search ..... 227/8, 131, 132

[56] References Cited

U.S. PATENT DOCUMENTS

| | | | |
|---|---|---|---|
| 3,282,489 | 11/1966 | March | 227/131 X |
| 3,786,978 | 1/1974 | Manganaro | 227/131 X |
| 4,121,745 | 10/1978 | Smith et al. | 227/131 X |
| 4,349,143 | 9/1982 | Ewig | 227/131 |

*Primary Examiner*—Mark Rosenbaum

[57] ABSTRACT

An electrically operated fastener driving device comprising a housing structure providing a manually engageable handle for engaging a user to portably operate the device, a front wall disposed in vertically extending relation forwardly and below the handle and a vertically extending fastener drive track disposed closely adjacent the front wall. A solenoid is carried by the housing structure forwardly of the handle and rearwardly and above the drive track and includes an elongated plunger having a longitudinal axis inclined with respect to the vertical. A cam and cam track mechanism is disposed between the upper end portion of the fastener driving element slidable in the drive track and the lower end portion of the plunger for causing a downward stroke of the plunger in response to the energization of the solenoid to effect a drive stroke of the fastener driving element. A torsional coil spring is provided in the housing structure for effecting a return stroke of the fastener driving element and plunger in response to the deenergization of the solenoid.

17 Claims, 5 Drawing Figures

ELECTRONIC TACKER

This invention relates to fastener driving devices and more particularly to power operated portable fastener driving devices.

Power operated portable fastener driving devices are well known. These devices are used in industrial applications quite extensively. For industrial applications compressed air provides a convenient power source. Because of the nature of the compressed air power source and the expense involved in these heavy duty industrial fastener driving devices, they are generally not suitable for widespread use in the various occasional fastening jobs which are required around a dwelling house or apartment. Spring tackers are available and in more widespread use for the typical home or apartment dweller. However, in many of the jobs where spring staplers or tackers are used, considerable fatigue may be involved. As an alternative to these problems, electrically operated staplers and tackers are available. These electrically operated devices avoid the inconvenience of the compressed air power source of the power operated devices for industrial uses. In general, they utilize the electrical energization of a solenoid to accomplish the driving action. There are many instances where devices of this type are used commercially in situations where electrical power is conveniently available and it would constitute an inconvenience to provide compressed air as a source of power. For example, there are many situations where installations in a house or apartment must be accomplished on a custom fitting basis, as, for example, the installation of screens, sun shields and the like, tacking of pool table felts, etc. The requirement in many of these commercial applications as well as other job situations around a house or apartment, is such as to necessitate the driving of fasteners into the workpiece in closely adjacent relation with a parallel surface. Existing electrical tackers are arranged so that the plunger of the solenoid is directly connected with the fastener driving element which is slidably mounted in the drive track of the device. Of course the plunger is surrounded by the solenoid coil which, in turn, must be encased within a housing wall. The end result of this type of construction is that the position at which the fastener is ejected from the drive track is spaced rearwardly from the front surface of the housing a considerable distance. Accordingly, the structural arrangement of prior art devices of this type precludes their use in the many applications where it is necessary to drive a fastener into a workpiece adjacent a surface which extends closely parallel with the fastener in the direction of drive.

Accordingly it is an object of the present invention to provide an electric fastener driving device which obviates the disadvantages noted above, thus enabling the device to function in those applications where prior art devices provided interference, as well as all of the other applications to which the prior art devices could be utilized. In accordance with the principles of the present invention this objective is obtained by providing an electrically operated fastener driving device which has a housing structure defining a manually engageable handle for enabling a user to portably operate the device, a front wall which is disposed in vertically extending relation forwardly and below the handle and a vertically extending fastener drive track which is disposed closely adjacent the front wall. The solenoid is carried by the housing structure forwardly of the handle and rearwardly and above the drive track with its plunger disposed so that its longitudinal axis is inclined with respect to the vertical. A cam and cam track connection is priovided between the upper end of a fastener driving element slidably mounted in the drive track and the lower end of the plunger for causing a downward stroke of the plunger in response to the energization of the solenoid to effect a drive stroke of the fastener driving element. Finally, a return spring is provided which is preferably in the form of a torsional coil spring, the central coil section thereof being disposed within the housing structure between the handle and a fastener magazine disposed below the handle for feeding successive leading fasteners of a package of fasteners forwardly into the drive track. An operative end section of the torsional coil spring is connected for movement with the solenoid plunger and the opposite end thereof is fixed with respect to the housing structure.

The above-described arrangement of the present invention provides a highly desirable and efficient housing for the functional components which achieves the desired relationship between the position at which the fasteners are driven and the forward surface of the housing while maintaining the device light and compact. Moreover, the working parts are not only conveniently housed, but operate efficiently as well.

Electrical fastener driving devices, like all devices of this type, present a safety problem. This is particularly true of tacker devices which, unless appropriate safety provisions are made, have the capability of shooting fasteners in the air like a gun. Accordingly, it has been proposed in the patented literature to provide electrically operated tackers with workpiece-engaging safety interlocking systems which prevent the user from energizing the solenoid simply by depressing the trigger. Such systems require that the device be engaged with the workpiece in order for the depression of the trigger to be effective to initiate the energization of the solenoid. Despite the safety precautions provided by such workpiece-engaging interlocking systems, it would still be a desirable feature to build into such devices the simple and convenient capability of rendering the device incapable of being fired.

It is a further object of the present invention to provide a fastener driving device with a capability of this type. In accordance with the principles of the present invention, this objective is obtained by mounting the workpiece-engaging structure of the device in an easily removable fashion so that it can be conveniently removed to disarm the device. Preferably, the removable workpiece-engaging structure is capable of being easily assembled selectively in either one of two operating modes, one of which is a screen or fabric pulling mode. Essentially the two operating mode positions are positions in which the workpiece-engaging structure is reverse oriented so that either end of the workpiece-engaging structure may constitute the workpiece-engaging end thereof. In the screen or fabric pulling mode, the workpiece-engaging structure is oriented in a position in which an end thereof having screen or fabric engaging claws becomes the workpiece engaging end. In the reverse orientation the workpiece-engaging end is of a more conventional nature providing a conventional operating mode.

A still further object of the present invention is to provide a fastener driving device of the type described which is simple in construction, economical to manufacture and effective in operation.

These and other objects of the present invention will become more apparent during the course of the following detailed description and appended claims.

The invention may best be understood with reference to the accompanying drawings, wherein an illustrative embodiment is shown.

Figure 1:
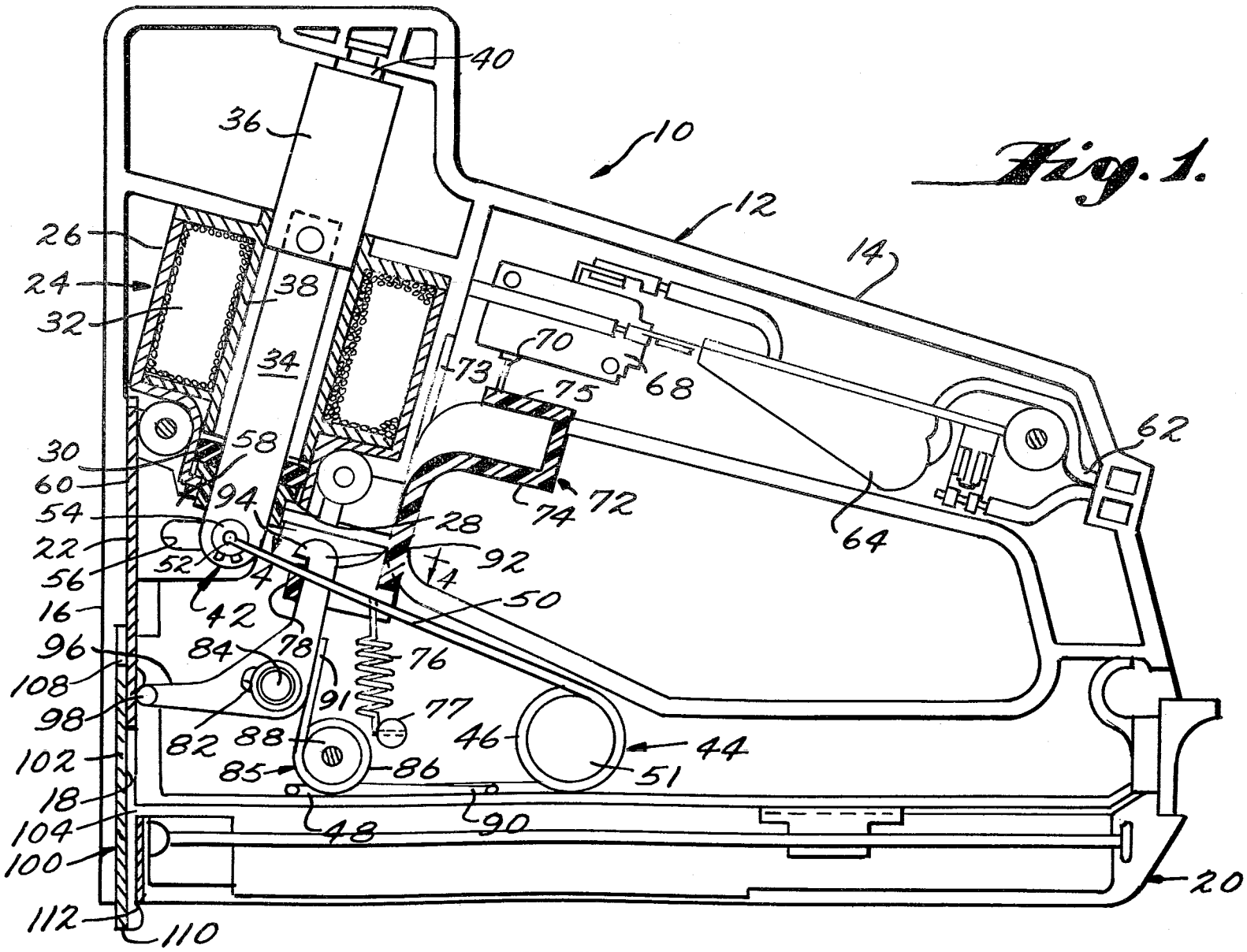
FIG. 1 is a vertical sectional view of a fastener driving device embodying the principles of the present invention, showing the same in its normal operative position.

Referring now more particularly to the drawings, there is shown in FIG. 1 thereof an electrically operated fastener drive device, generally indicated at 10, which embodies the principles of the present invention. The device 10 includes a housing structure, generally indicated at 12. While the housing structure may assume any desired construction, in the preferred embodiment shown the housing structure is formed of two complementary half parts, each of which is formed as a molding of a suitable plastic material. An exemplary material is LEXAN®. When the two half parts constituting the housing structure are secured together in cooperating relation with respect to each other, they define a handle 14 for enabling a user to portably operate the device through a manually gripping action thereon. The housing structure 12 also defines a front wall 16 which is disposed in vertically extending relation forwardly and below the handle 14. The housing structure also defines a vertically extending fastener drive track 18 which is disposed closely adjacent the front wall 16.

A fastener magazine assembly, generally indicated at 20, is carried by the housing structure 12 in a position below the handle 14. The magazine assembly may be of any conventional type, however, as shown, the magazine is of the top loading type which includes a tray-like structure slidably mounted within the housing structure 12 for horizontal reciprocating movement between an inner operative position and an outer loading position. In accordance with conventional procedure, when the tray structure is in its outer loading position a spring pressed pusher is first moved rearwardly to allow the insertion of an appropriate package of fasteners as, for example, a staple stick package. The magazine assembly is movable from the outwardly extending loading position into a forward operating position wherein the assembly is operable to feed successive leading fasteners of the package forwardly into the drive track 18.

Slidably mounted within the drive track 18 is a fastener driving device 22, the sliding movement accommodating successive operative cycles of movement, each of which includes a downward drive stroke from a normally inoperable position wherein the lower striking surface of the fastener driving element is disposed above the crown of a staple fed to the drive track from the fastener magazine assembly 20 into a staple driven position during which the lower striking surface of the fastener driving element engages the crown of the leading staple in the drive track and moves the same outwardly thereof into the desired workpiece. The operative cycle of movement of the fastener driving element 22 also includes a return stroke in accordance with conventional practice, during which the next leading staple of the package is fed into the drive track as the lower striking end of the fastener driving element 22 moves by the leading staple in the magazine assembly.

For the purpose of effecting the movement of the fastener driving element 22 through successive operative cycles of movement, there is provided an electrical solenoid assembly, generally indicated at 24, which is carried by the housing structure in a position forwardly of the handle 14 and rearwardly and above the front wall 16 and drive track 18. Preferably, the solenoid assembly constitutes a separately packaged sub-assembly consisting of a casing 26 of generally bottle-shaped configuration disposed in inverted relation so that its mouth faces downwardly. Disposed within the mouth of the casing is a bushing 28 of suitable bearing material as, for example, nylon. Mounted on the bushing 28 is an annular bumper 30 made of suitable resilient material as, for example, rubber. A solenoid coil 32 is mounted within the main body portion of the casing 26. Mounted within the coil 32 is a plunger assembly 34 including a lower portion of suitable dielectric material as, for example, DELRIN®. The upper portion of the plunger structure is constituted by a piston 36 of suitable ferromagnetic material which is guided by sliding movement through a closure wall 38 formed as a part of the solenoid casing 26. The piston 36 is adapted to engage a bumper stop 40 for the purpose of determining the upper limiting position of the plunger structure. The guiding movement provided by the piston 36 slidably supported within the wall 38 together with the sliding movement of the lower end portion of the plunger 34 through the bushing 28 provides for successive reciprocating cycles of movement of the solenoid plunger structure along an axis which is inclined with respect to the vertical. The axis of inclination is preferably limited to that which will enable the position of the housing structure 12 enclosing the solenoid assembly 24 to be disposed just rearwardly of the front wall 16 of the housing structure. As shown, the angle is approximately 15°.

Figure 2:
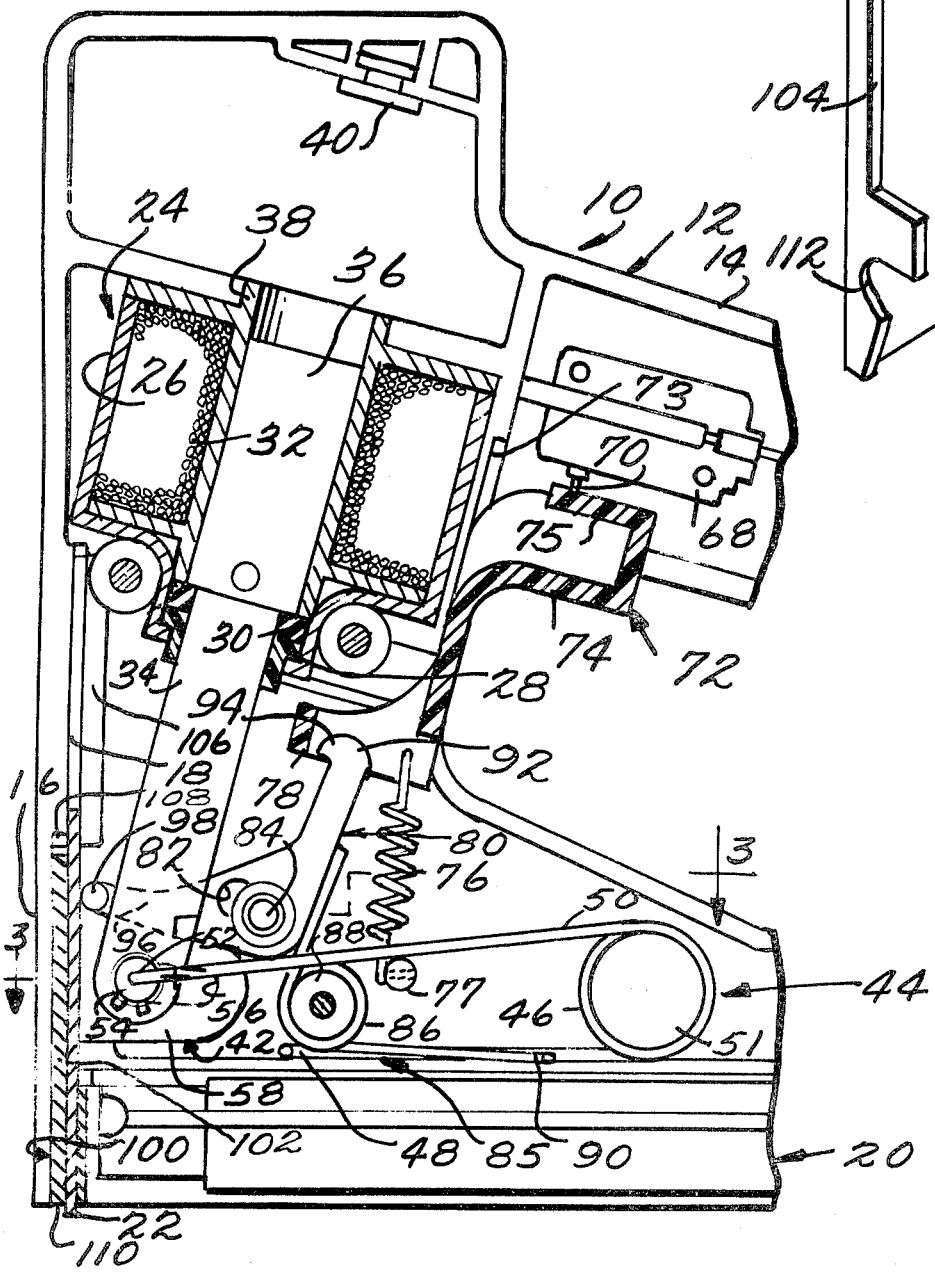
FIG. 2 is a fragmentary sectional view similar to FIG. 1 showing the position of the parts at the end of a drive stroke.
Figure 3:
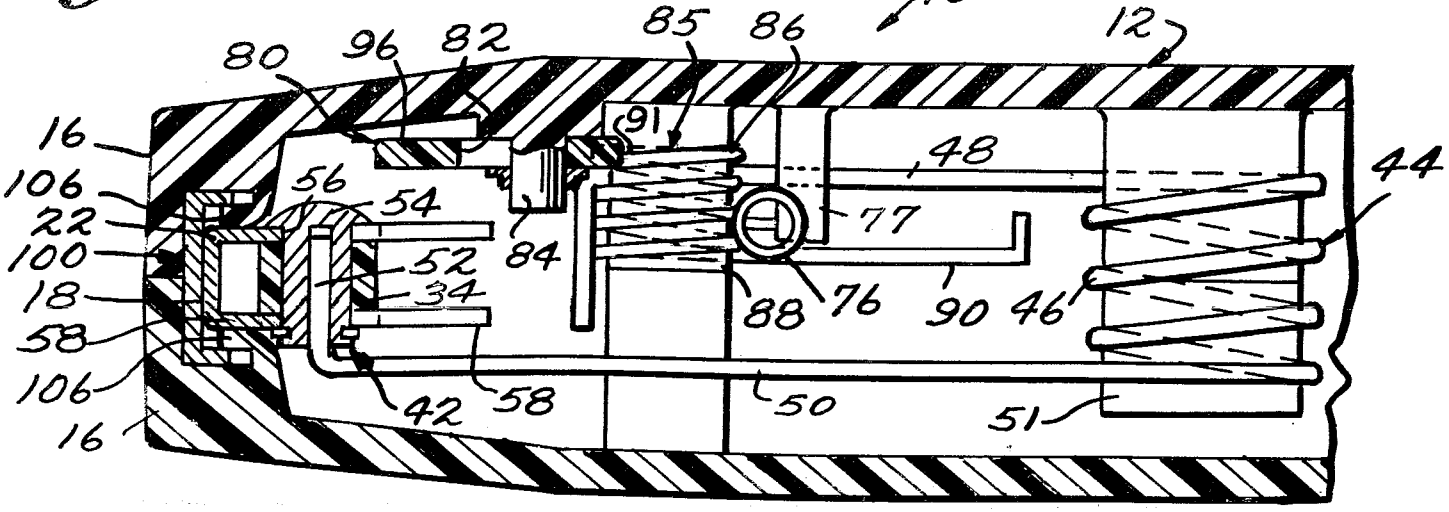
FIG. 3 is an enlarged fragmentary sectional view taken along the line 3—3 of FIG. 2.

A cam roller and cam track mechanism generally indicated at 42, is provided between the lower end portion of the solenoid plunger 34 and the upper end portion of the fastener driving element 22 so that when the solenoid assembly is actuated to move the solenoid plunger through successive operating cycles of movement the fastener driving element will correspondingly be moved through successive operating cycles of movement. In accordance with usual practice the solenoid assembly 24 is operable when energized to effect the downward drive stroke of the solenoid plunger. The upward return stroke of the solenoid plunger which completes the operating cycle of movement thereof is accomplished by a return spring which is generally indicated at 44. As shown, the return spring 44 is in the form of a torsional coil spring which includes a central helically coiled portion 46 having a fixed mounting end 48 extending from one end thereof and an elongated movable end 50 extending from the other end thereof. As best shown in FIGS. 1 and 2, the central coil portion 46 of the spring 44 is mounted on a boss 51 within the housing in a position between the handle 14 and the magazine assembly 20 rearwardly of the drive track 18 and fastener driving element 22. The movable end portion 50 has its free end bent transversely, as indicated at 52, and engaged within a cam roller 54 forming a part of the cam roller and cam track mechanism 42. As best shown in FIG. 3, the central portion of the cam roller 54 is rotatably mounted in a suitable aperture formed in the lower end of the plunger structure 34. The opposite ends of the roller rollingly engage within a pair of cam tracks or slots 56 formed within the legs of a U-shaped cam track member 58. As best shown in FIGS. 1–3, the bight portion of the U-shaped track member 58 is an integral part of the fastener driving element 22. However, a separate U-shaped member 58 may be provided in which case the bight thereof is fixed to the upper rear surface of the fastener driving element 22 by a suitable fastening means as, for example, a rivet or brazing.

It will be noted that spring 44 serves to normally bias the plunger structure 34 of the solenoid 24 into its uppermost position, as shown in FIG. 1, wherein the piston 36 is disposed in engagement with the bumper 40. In this position, cam roller 54 engages within the rearward portion of the cam tracks 56 and the fastener driving element 22 is disposed in its uppermost position. In order to energize the coil 32 of the solenoid 24 so as to effect a magnetic movement of the piston 36 downwardly within the coil 32, the coil must be energized with a direct electrical current. The device 10 is preferably adapted to be connected with a source of alternating current, as by a lead wire 62. The lead wire 62 is connected with a suitable rectifier circuit 64 disposed within the handle as well as a coil energizing switch 68.

Figure 4:
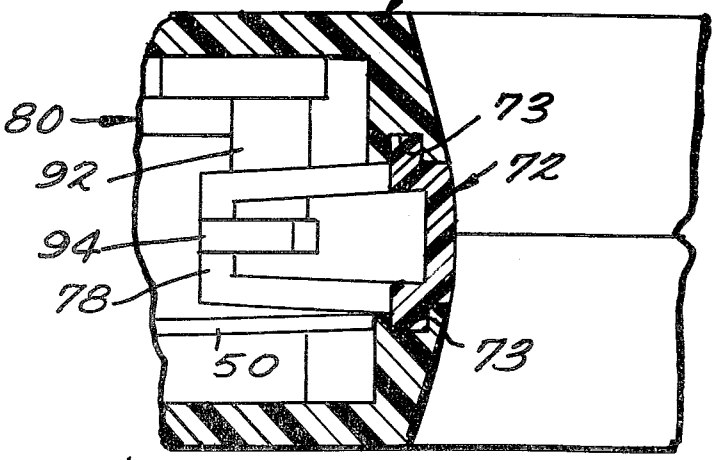
FIG. 4 is an enlarged fragmentary sectional view taken along the line 4—4 of FIG. 1.

The coil energizing switch 68 is a normally open switch which is adapted to be closed by depression of an actuating plunger 70. Plunger 70 is connected to be actuated by the movement of a trigger structure, generally indicated at 72, mounted for reciprocating movement within the housing, as by a pair of grooves 73 (see FIG. 4). The trigger structure 72 is resiliently biased into an extended limiting position wherein the index finger of a user gripping the handle 14 is in a position to conveniently engage and move upwardly a finger engaging central portion 74 of the trigger structure. An upper cantilevered portion 75 of the trigger structure is connected with the switch plunger 70. As shown, the resilient biasing means for urging the trigger structure into its normal inoperative position comprises a coil spring 76 connected between the trigger structure and a boss 77 within the housing. The trigger structure 72 also includes a U-shaped lower stop portion 78 which is adapted to be cooperatively engaged by a safety interlock lever, generally indicated at 80, as is best shown in FIG. 4. The safety interlock lever 80 is preferably made of a plastic material, for example, Delrin®, and is molded with a central portion having a horizontally elongated opening 82 formed therein. The opening 82 receives an integral shaft or pin portion 84 formed in one of the housing parts.

A torsional coil spring 85 similar to spring 44 is provided for resiliently biasing the lever 80 to move forwardly and to pivot counterclockwise (as viewed in FIGS. 1 and 2) with respect to the pin 84. As shown, the torsional coil spring 85 for the lever 80 includes a central coil portion 86 mounted on a boss 88 formed on a housing part. Extending from one end of the coil portion 86 is a fixed end portion 90 suitably secured to the housing. An opposite end portion 91 is engaged with an upwardly and inwardly extending stop arm 92 formed on the lever 80 which has a hook-shaped upper extremity 94 adapted to overlie the bight of the stop portion 78 of the trigger structure 72. The hook-shaped upper extremity 94 is held in the engaged position with the stop portion 78 of the trigger 72 by the forward elongated movable end portion 91 of the torsional coil spring 85.

Figure 5:
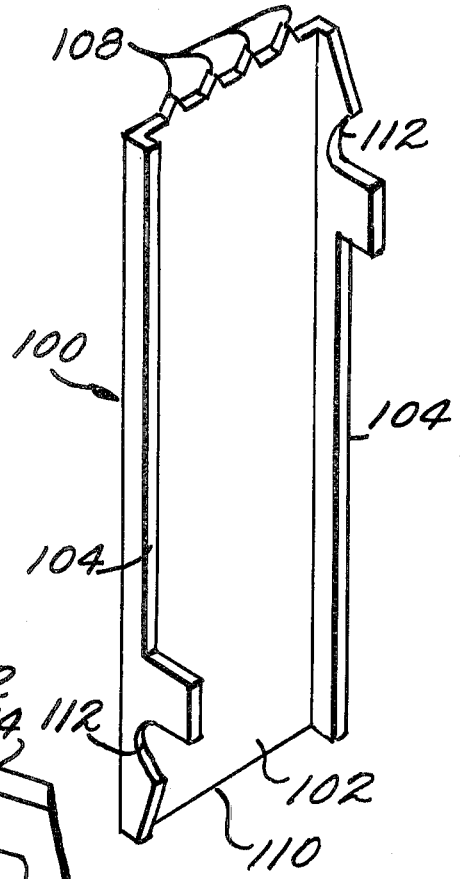
FIG. 5 is an isometric view of the reversible workpiece engaging structure.

The lever 80 also includes a forwardly extending arm 96 having a transversely extending cylindrical end 98 on the forward extremity thereof. The cylindrical end portion 98 is adapted to cooperate with a workpiece engaging structure, generally indicated at 100, and shown in FIG. 5. The workpiece engaging structure 100 is preferably constructed from a sheet of metal bent into a U-shaped cross-sectional configuration so as to provide a central bight portion 102 having a pair of leg portions 104 extending therefrom in generally parallel relation.

As best shown in FIG. 3, the housing parts are configured so as to provide a downwardly opening cavity in the forward lower portion thereof within which the workpiece engaging structure 100 is adapted to be inserted. It will be noted that each housing part includes integral portions 106 which serve to engage around the free ends of the leg portions 104 along a central section thereof when the workpiece engaging structure 100 is inserted from a removed position upwardly within the aforesaid cavity into a normal inoperative position, as shown in FIG. 1. In this regard, it will be noted that the workpiece engaging structure 100 has one end surface of the bight portion 102 thereof formed with a plurality of screen or fabric pulling projections in the form of integral triangular teeth 108, while the other end thereof is planar, as indicated at 110. Moreover, it will be noted that despite this difference in the end edges of the work engaging structure, the same is otherwise capable of being inserted within the aforesaid cavity provided by the housing in reversible fashion so that either of the ends 108 or 110 is disposed downwardly. In this regard, it will be noted that there is formed in each of the leg portions 104 of the workpiece engaging structure 100 adjacent each end thereof a cam-like notch 112 within selected ones of which the cylindrical end 98 provided by the lever 80 is adapted to engage when the workpiece engaging structure is inserted into its normal inoperative position.

As previously indicated, the connection of the end portion 91 of the torsional coil spring 85 with arm 82 of the lever 80 resiliently biases the lever 80 into the position shown in FIG. 1. It will also be noted that by virtue of the elongated slot 82 in the lever 80, the latter is capable of yieldable compound movement, which includes a translationally rearward movement in the direction of the elongation of the slot 82 and a pivotal movement about the axis of the pivot 84. The translational movement accommodates the cammed interengagement of the cylindrical portion 98 of the mounting arm 96 in an associated cam notch 112 in response to the upward insertional movement of the workpiece engaging structure 100 from its removed position into the normal inoperative position shown in FIG. 1 irrespective of the end orientation thereof. When the cylindrical end 98 of the arm 96 is engaged within the associated cam notch 112, the workpiece engaging structure is capable of reciprocating movement from the normal inoperative position shown in FIG. 1 wherein the lower end portion thereof extends downwardly below the lower surface of the forward wall 16 of the housing 12 and an upper operative position wherein the lower surface of the workpiece engaging structure is disposed in the same level as the lower surface of the front wall 16. The movement of the workpiece engaging structure 100 from its normal inoperative position to its retracted operative position is accomplished by the operator moving the device into operative engagement of the workpiece into which a fastener is to be driven. This upward retracting movement of the workpiece engaging structure effects a pivotal movement of the lever 80 in a clockwise direction, as viewed in FIG. 1, about the pivot provided by pin portion 84. The angular movement is sufficient to displace the hooked end 94 of the lever arm 92 out of the path of movement of the bight portion 78 of the trigger structure 72. Consequently, when the trigger structure 72 is manually moved into its retracted operative position, the electrical circuit to the solenoid coil is completed and the energization of the coil causes the piston 36 to move downwardly into the center of the coil. This movement of the piston 36 causes the plunger 34, in turn, to move through its downward stroke which, by virtue of the cam roller and cam track mechanism 42, will in turn cause the fastener driving element 22 to move through its fastener driving stroke. During the fastener driving stroke of the fastener driving element 22, the leading fastener moved into the drive track 18 from the magazine assembly 20 is engaged and moved outwardly of the drive track and into the workpiece. Also during the fastener driving stroke spring 44 is stressed so that the spring energy stored therein can be utilized to effect the return stroke. At the end of the drive stroke, the return stroke is initiated automatically by the one-shot energizing circuitry in accordance with known technology, resulting in the de-energizing of solenoid coil 32. As soon as coil 32 is de-energized, the fastener driving element 22 and plunger 34 move through their return strokes under the action of stressed spring 44. It will be understood that the one-shot circuitry functions to require the release of trigger structure 72 and the resultant opening of switch 68 to condition the device for another fastener driving operation.

It will be appreciated that the features of the electrically operated tacker described above are suitable to be actuated by conventional interlocked trigger and work engaging structure and that the removable and reversible features of the work engaging structure are readily embodied in other types of fastener driving devices, such as pneumatically operated devices and the like.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. An electrically operated fastener driving device comprising a housing structure including means defining a manually engageable handle for enabling a user to portably operate such a device, front wall means disposed in vertically extending relation forwardly and below said handle and means defining a straight vertically extending fastener drive track disposed closely adjacent said front wall means, fastener magazine means disposed below said handle for feeding successive leading fasteners of a package of fasteners forwardly into said drive track, a rigid fastener driving element slidably mounted in said drive track for movement through successive rectilinear reciprocating cycles of operation including a downward drive stroke during which a leading fastener fed within the drive track is engaged and moved outwardly of said drive track and an upward return stroke, solenoid means carried by said housing structure forwardly of said handle and rearwardly and above said drive track, said solenoid means including elongated plunger means having a longitudinal axis inclined with respect to the vertical mounted for movement through successive reciprocating cycles of operation including a downward stroke along its axis and an upward return stroke, cam means between an upper end portion of said fastener driving element and a lower end portion of said plunger means for causing a downward stroke of said plunger means in response to the energization of said solenoid means to effect a drive stroke of said fastener driving element, and return spring means for effecting a return stroke of said fastener driving element and said plunger means in response to the deenergization of said solenoid means, said return spring means including a central coil section disposed within said housing structure between said handle and said fastener magazine means, an operative end section extending from one end of said central coil section and connected for movement with said plunger means and a fixed end section extending from the opposite end of said central coil section and connected in operatively fixed relation with respect to said housing structure.

2. An electrically operated fastener driving device as defined in claim 1 wherein said cam means comprises a cam roller rotatably mounted in a lower end of said plunger means and a U-shaped member having a bight portion fixed to said fastener driving element and parallel leg portions having elongated slots therein defining cam roller receiving cam tracks.

3. An electrically operated fastener driving device as defined in claim 1 or 2 wherein said plunger means includes an elongated cylindrical dielectric member having a ferro-magnetic piston on the upper end thereof.

4. An electrically operated fastener driving device as defined in claim 3 wherein said solenoid includes a casing having a solenoid coil therein, a resilient bumper member below said coil for engaging said piston when said plunger means has moved through its drive stroke and a bushing below said bumper guidingly receiving said cylindrical dielectric member therein.

5. An electrically operated fastener driving device as defined in claim 1 or 2 wherein said housing structure includes complementary cooperating half parts molded of a plastic material.

6. An electrically operated fastener driving device as defined in claim 1 or 2 wherein the longitudinal axis of said plunger means has an angle of inclination of approximately 15°.

7. An electrically operated fastener driving device as defined in claim 1 or 2 wherein the operative end section of said return spring means includes a transversely extending extremity engaged within a central opening in said cam roller.

8. An electrically operated fastener driving device as defined in claim 1 or 2 including a manually engageable structure carried by said housing means adjacent said handle for movement between an extended disengaged position and a retracted manually engaged position, a workpiece engaging structure, releasable connecting means (1) connectible with said workpiece engaging structure so as to enable the same to be moved between an extended disengaged position and a retracted workpiece engaged position and (2) releasable from said workpiece engaging structure so as to enable said workpiece engaging structure to be removed from said device, and means operatively associated with said releasable connecting means and operatively connected with said manually engageable structure for (1) preventing energization of said solenoid means (a) when said workpiece engaging structure is connected with said releasable connecting means and is in its extended position and (b) when said workpiece engaging structure is released from said releasable connecting means and removed from said device, and (2) enabling the energization of said solenoid means when said workpiece engaging structure is connected with said releasable connecting means and in said retracted workpiece engaged position and said manually engageable structure is in its retracted manually engaged position.

9. An electrically operated fastener driving device as defined in claim 1 or 2 including a manually engageable structure carried by said housing means adjacent said handle for movement between an extended disengaged position and a retracted manually engaged position, a workpiece engaging structure carried by said housing means adjacent said drive track for (1) selective movement into either one of two different operative mode positions, one of which is a screen or fabric pulling mode and (2) movement while in either one of said operative mode positions between an extended disengaged position and a retracted workpiece engaged position, and means operatively connecting said manually engageable structure with said workpiece engaging structure operable while the latter is in either of said operative mode positions to prevent energization of said solenoid means when said workpiece engaging structure is in its extended disengaged position and to accomplish energization of said solenoid means when both of said structures are moved into their retracted engaged positions.

10. An electrically operated fastener driving device as defined in claim 1 or 2 including a manually engageable structure carried by said housing means adjacent said handle for movement between an extended disengaged position and a retracted manually engaged position, a workpiece engaging structure carried by said housing means adjacent said drive track for (1) selective movement into either one of two different operative mode positions, one of which is a screen or fabric pulling mode and (2) movement while in either one of said operative mode positions between an extended disengaged position and a retracted workpiece engaged position, and (3) released movement into a disabling position removed from said device, means operatively associated with said manually engageable structure for (1) preventing energization of said solenoid means (a) when said workpiece engaging structure is in its extended disengaged position in either operative mode position and (b) when said workpiece engaging structure is in its disabling position and for (2) enabling energization of said solenoid means when said manually engageable structure is in its retracted manually engaged position and said workpiece engaging structure is in its retracted workpiece engaged position in either operative mode position.

11. An electrically operated fastener driving device as defined in claim 10 wherein said energization enabling and preventing means includes normally open switch means operatively connected between a source of DC power and a coil of said solenoid means movable into a closed circuit completing position in response to the movement of said manually engageable structure into its retracted manually engaged position and a lever having a first arm releasably operatively connected with said workpiece engaging structure for movement between first and second positions in response to the movement of said workpiece engaging structure between its extended and retracted positions, said lever having a second arm operable (1) when said lever is in its first position to prevent movement of said manually engageable structure from its extended position into its retracted position and (2) when said lever is in its second position to enable movement of said manually engageable structure from its extended position into its retracted position.

12. An electrically operated fastener driving device as defined in claim 11 wherein said lever is mounted within said housing means for pivotal movement between said first and second positions and for lateral shifting movement to releasably engage and disengage said workpiece engaging structure and spring means for resiliently urging said lever into said first position of pivotal movement and into an engaged position of lateral shifting movement.

13. A fastener driving device comprising housing means defining a handle for enabling a user to portably operate the device, means defining a generally vertically extending drive track in said housing means, fastener magazine means for feeding successive leading fasteners of a package of fasteners forwardly into said drive track, a fastener driving element slidably mounted in said drive track for movement through successive operating cycles of movement including a downward drive stroke during which a leading fastener fed into said drive track is engaged and driven outwardly thereof and an upward return stroke, power operated means for effecting successive operating cycles of movement of said fastener driving element in response to actuation thereof, a manually engageable structure carried by said housing means adjacent said handle for movement between an extended disengaged position and a retracted manually engaged position, a workpiece engaging structure, releasable connecting means (1) connectible with said workpiece engaging structure so as to enable the same to be moved between an extended disengaged position and a retracted workpiece engaged position and (2) releasable from said workpiece engaging structure so as to enable said workpiece engaging structure to be removed from said device, and means operatively associated with said releasable connecting means and operatively connected with said manually engageable structure for (1) preventing actuation of said power operated means (a) when said workpiece engaging structure is connected with said releasable connecting means and is in its extended position and (b) when said workpiece engaging structure is released from said releasable connecting means and removed from said device, and (2) enabling the actuation of said power operated means when said workpiece engaging structure is connected with said releasable connecting means and in said retracted workpiece engaged position and said manually engageable structure is in its retracted manually engaged position.

14. A fastener driving device comprising housing means defining a handle for enabling a user to portably operate the device and a generally vertically extending drive track, fastener magazine means for feeding successive leading fasteners of a package of fasteners forwardly into said drive track, a fastener driving element slidably mounted in said drive track for movement through successive operating cycles of movement including a downward drive stroke during which a leading fastener fed into said drive track is engaged and driven outwardly thereof and an upward return stroke, power operated means for effecting successive operating cycles of movement of said fastener driving element in response to actuation thereof, a manually engageable structure carried by said housing means adjacent said handle for movement between an extended disengaged position and a retracted manually engaged position, a workpiece engaging structure carried by said housing means adjacent said drive track for (1) selective movement into either one of two different operative mode positions, one of which is a screen or fabric pulling mode and (2) movement while in either one of said operative mode positions between an extended disengaged position and a retracted workpiece engaged position, and means operatively connecting said manually engageable structure with said workpiece engaging structure operable while the latter is in either of said operative mode positions to prevent actuation of said power operated means when said workpiece engaging structure is in an extended disengaged position and to accomplish actuation of said power operated means when both of said structures are moved into their retracted engaged positions.

15. A fastener driving device comprising housing means defining a handle for enabling a user to portably operate the device and a generally vertically extending drive track, fastener magazine means for feeding successive leading fasteners of a package of fasteners forwardly into said drive track, a fastener driving element slidably mounted in said drive track for movement through successive operating cycles of movement including a downward drive stroke during which a leading fastener fed into said drive track is engaged and driven outwardly thereof and an upward return stroke, power operated means for effecting successive operating cycles of movement of said fastener driving element in response to actuation thereof, a manually engageable structure carried by said housing means adjacent said handle for movement between an extended disengaged position and a retracted manually engaged position, a workpiece engaging structure carried by said housing means adjacent said drive track for (1) selective movement into either one of two different operative mode positions, one of which is a screen or fabric pulling mode, (2) movement while in either one of said operative mode positions between an extended disengaged position and a retracted workpiece engaged position, and (3) released movement into a disabling position removed from said device, means operatively associated with said manually engageable structure for (1) preventing actuation of said power operated means (a) when said workpiece engaging structure is in its extended disengaged position in either operative mode position and (b) when said workpiece engaging structure is in its disabling position and for (2) enabling actuation of said power operated means when said manually engageable structure is in its retracted manually engaged position and said workpiece engaging structure is in its retracted workpiece engaged position in either operative mode position.

16. A fastener driving device as defined in claim 15 wherein said actuation enabling and preventing means includes a lever having a first arm releasably operatively connected with said workpiece engaging structure for movement between first and second positions in response to the movement of said workpiece engaging structure between its extended and retracted positions, said lever having a second arm operable (1) when said lever is in its first position to prevent movement of said manually engageable structure from its extended position into its retracted position and (2) when said lever is in its second position to enable movement of said manually engageable structure from its extended position into its retracted position.

17. A fastener driving device as defined in claim 16 wherein said lever is mounted within said housing means for pivotal movement between said first and second positions and for lateral shifting movement to releasably engage and disengage said workpiece engaging structure and spring means for resiliently urging said lever into said first position of pivotal movement and into an engaged position of lateral shifting movement.

* * * * *